United States Patent [19]

Maillet

[11] 3,942,323

[45] Mar. 9, 1976

[54] HYDRO OR OLEOPNEUMATIC DEVICES

[76] Inventor: Edgard Jacques Maillet, Chateau de l'Ermitage, Ludow Medoc 33290 Blanquefort, France

[22] Filed: Oct. 8, 1974

[21] Appl. No.: 513,066

[30] Foreign Application Priority Data

Oct. 12, 1973 France ..... 73.36457

[52] U.S. Cl. ..... 60/413; 60/415; 60/560

[51] Int. Cl.[2] ..... F15B 1/02

[58] Field of Search ..... 60/407, 408, 412, 413, 60/414, 415, 560, 370, 371

[56] References Cited

UNITED STATES PATENTS

| | | | |
|---|---|---|---|
| 1,038,521 | 9/1912 | Behr | 60/370 X |
| 2,554,381 | 5/1951 | Patterson | 60/413 X |
| 2,721,446 | 10/1955 | Bumb | 60/415 |
| 3,163,005 | 12/1964 | Reed | 60/415 X |

*Primary Examiner*—Edgar W. Geoghegan
*Attorney, Agent, or Firm*—Edwin E. Greigg

[57] ABSTRACT

A hydro or oleopneumatic device comprises a pressure transformer consisting of a single or multiple pneumatic cylinder having one or a number of stages in which the piston is rigidly coupled to an accumulator. The accumulator piston discharges the liquid to a function jack which utilizes the energy produced by the pneumatic pressure. The pneumatic cylinder is not provided with compressed-air exhaust ports and is freely connected to a compressed-air reservoir at the working pressure. The volume VR of the reservoir is large in comparison with the volume VC of the pneumatic cyclinder, the ratio VC/(VR + VC) being equal to the permissible variation in the working pressure of the air according to the intended use of the device.

6 Claims, 3 Drawing Figures

HYDRO OR OLEOPNEUMATIC DEVICES

This invention relates to piston-type hydro and oleopneumatic devices, that is to say devices in which the piston of a single-stage or multi-stage pneumatic cylinder driven by compressed air is rigidly coupled to the piston of a hydraulic cylinder which discharges its fluid towards a so-called "function " jack which utilizes the energy supplied.

The hydraulic cylinder is usually referred-to as an accumulator whilst the assembly which is formed by this latter in conjunction with the pneumatic cylinder is referred-to as a pressure transformer.

In a device of this type, the liquid of the accumulator is only a convenient means for transmitting pressure. It is clear that a judicious choice of the ratios between the different diameters of the pistons (of the accumulator and of the stage or stages of the pneumatic cylinder) makes it possible to obtain a high predetermined pressure at the outlet of the accumulator without exceeding in the case of compressed air a moderate pressure which is compatible with the strength of a simple structure of the pneumatic circuit and of its joints, that is to say a pressure below twelve bars and usually of the order of seven bars in workshops.

Certain piston-type hydro or oleopneumatic devices are of the so-called "resistant" type and two examples in which these latter are employed for the practical application of a pressure transformer in accordance with the invention will be given hereinafter. The very great majority of these devices, however, are of the so-called "driving" type: in this case the pneumatic cylinder of the pressure transformer of known devices is supplied with compressed air by a compressor or a distribution network. When the piston of the pneumatic cylinder or of each stage of the pneumatic cylinder reaches the end of the active stroke, the compressed-air supply of said cylinder is closed whilst one or a number of exhaust ports are opened. The return stroke is obtained whilst the air exhaust ports remain open by admitting a fluid under pressure into the function jack chamber opposite to the chamber which is connected to the accumulator; said fluid is usually air delivered by the compressor or the network since the only resistances to be overcome are friction forces and the inertia of sliding components (pistons and piston rods).

The use of hydro or oleopneumatic control systems tends to develop as the improvements achieved in the efficiency of tools and the design of machines reduce the length of machining operations since dead times accordingly assume increasing significance. Pneumatic control systems are in fact capable of carrying movements at much higher speeds than hydraulic control systems; they also exhibit a higher degree of flexibility (progressive start-up) as well as being of more simple and more rugged design. When employed alone, however, these hydraulic systems are subject to a disadvantage in that they lack precision in the law of motion and cannot readily be operated at higher pressures, with the result that provision cannot be made for jacks of small overall size although this is often an essential requirement in machines in which available space is always limited.

In order to overcome the drawbacks mentioned in the foregoing while benefiting by the main advantages of pneumatic control systems, use is accordingly made of hydro or oleopneumatic control units, that is to say pneumatic control units of the type in which provision is made for hydraulic transmission systems. As has been stated in the foregoing, it is possible by this means to obtain high pressures in the hydraulic function jack and also to obtain hydraulic control of the speed of motion of the jack without thereby relinquishing flexibility of operation of the pneumatic control system.

However, pneumatic transmission of energy always takes place with very low efficiency by reason of the fact that the expansion is not utilized. In a pneumatic control system, the energy of expansion of air is never utilized since it is endeavored to obtain good specific mass output and to prevent cooling and above all because maximum effort and consequently maximum pressure are required at the end of travel. The quantity of energy thus lost is greater as the working pressure is higher but even in the case of relatively low pressures such as those employed in workshops (7 to 8 bars) the efficiency is lower than 35 %. This major disadvantage of pneumatic energy from the point of view of capital outlay (immobilization of capital in installed power capacity and operating costs) does not disappear simply by adding a hydraulic transmission system and remains in hydro or oleopneumatic control devices of known types.

Moreover, the compressor which feeds the pneumatic cylinder draws-in atmospheric air together with its dust particles and its humidity. In order to retain the dust particles, the air must therefore be filtered usually on the downstream and on the upstream side of the compressor, provision being preferably made for a dehydrating filter on the downstream side. A reservoir fitted with a manual or automatic drain system must also be provided at each bottom point of the system for the purpose of collecting the condensed water. In spite of these precautions, condensation in piping and utilization cylinders is substantial and gives rise to oxidation of metallic surfaces by reason of the fact that the proportion of water vapor in atmospheric air is far from being negligible (between 5 and 10 g/m$^3$ in France) and that the volume of indrawn air is substantial (of the order of 500 m$^3$/hr with a 100 HP compressor on a 50 % load). Finally, exhausts are often discharged directly into workshops, thus giving rise to reduction in room temperature both as a result of cooling caused by expansion and as a result of continuous renewal of the air in the workshop, thereby increasing heating costs during the winter.

While they prove wholly satisfactory from the strict viewpoint of action, hydro or oleopneumatic control systems are subject to economic disadvantages which all arise from the exhaust of the pneumatic portion of the system.

For this reason, the invention provides an arrangement such that the exhaust aforesaid is entirely suppressed together with the expansion of compressed air, the pressure of which remains substantially constant or at least within two limits which are as close together as may be desired. For this reason alone the efficiency is more than doubled and the disadvantages arising from humidity and ambient cooling are eliminated since the air is not changed.

Furthermore, since the pressure obtained at the outlet of the accumulator is also substantially constant, a "resistant" device can be equipped with the pressure transformer which is not liable to cause any overload or abrupt return.

A hydro or oleopneumatic device in accordance with the invention is distinguished by the fact that the pneumatic cylinder of the pressure transformer is not provided with exhaust ports for the discharge of compressed air and is freely connected to a compressed-air reservoir at the working pressure, the volume VR of said reservoir being substantial in comparison with the volume VC of said pneumatic cylinder, the ratio $$\frac{VC}{VR + VC}$$

being equal to the permissible variation in the working pressure of the air according to the intended use of the device.

A clearer understanding of the invention will be gained from the following description of three nonlimitative examples of application which are shown diagrammatically in the accompanying drawings, wherein.

Figure 1:
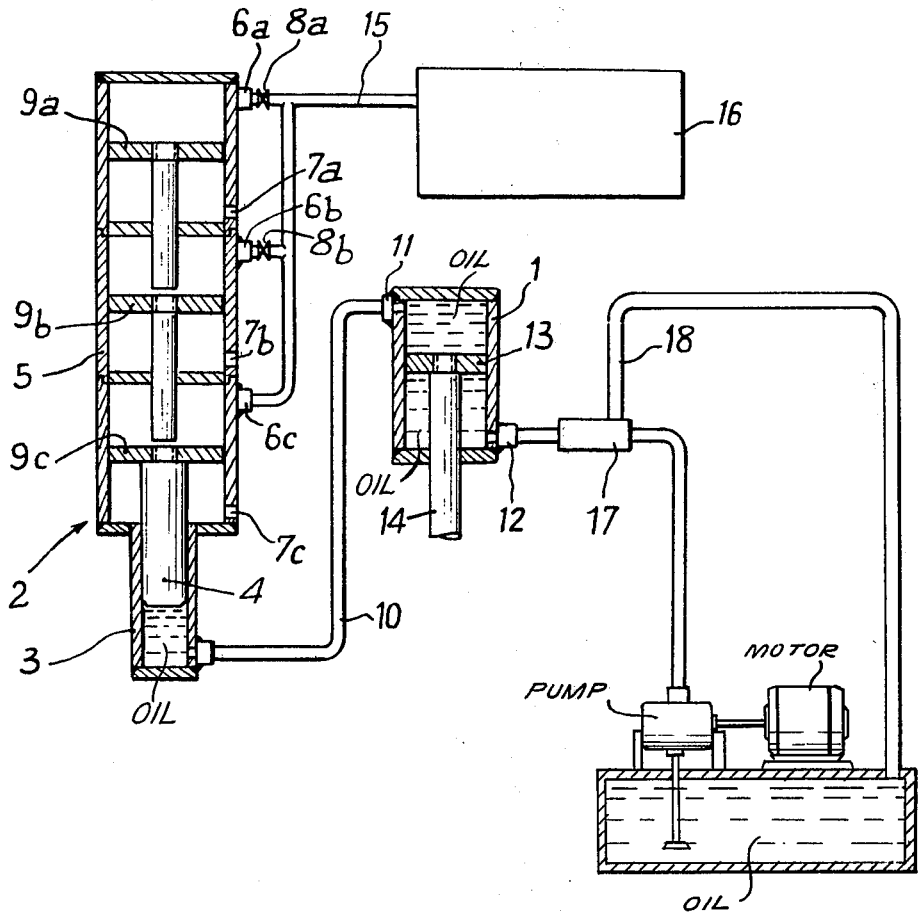
FIG. 1 illustrates the oleopneumatic control system of a die-stamping press.

In FIG. 1, the active stroke of the function jack 1 of a die-stamping press is controlled by an oleopneumatic pressure transformer 2. The transformer 2 comprises a hydraulic accumulator 3 which delivers its oil towards the jack 1 via a pipe 10 and the piston 4 of which is actuated by a three-stage pneumatic cylinder 5. Each stage of the cylinder 5 is provided with a compressed-air admission port 6*a*, 6*b*, 6*c* which opens into the pressure chamber in the vicinity of the end-wall of the stage considered and at the opposite extremity with a port 7*a*, 7*b*, 7*c* for communication with free air. Valves 8*a*, 8*b* placed at the inlets of at least two stages serve to limit the admission of air to one or two stages or on the contrary to supply the three stages together. Each piston 9*a*, 9*b* is capable of producing action on the following piston by means of its piston-rod and the last piston 9*c* is rigidly fixed to the piston 4 of the accumulator. The function jack 1 is a double-acting jack and a port 12 for supplying the chamber which is traversed by the rod 14 of the piston 13 is provided at the end remote from the port 11 through which the pipe 10 opens into the chamber formed and limited by the free face of the piston 13 of said jack.

The arrangement described thus far is identical with the arrangement found in conventional oleopneumatic control systems. In these latter, however, the compressed-air supply pipe 15 is connected to one of the outlets of an electrovalve which is fed by a compressor (or a distribution network) and provided with two other outlets, one outlet being connected to the port 12 of the jack 1 and the other outlet being intended to discharge to free air. In one position of the electrovalve, the pipe 15 is in communication with the compressor whilst the port 12 communicates with the exhaust and, in the other position of the electrovalve, the port 12 is connected to the compressor whilst the pipe 15 communicates with the exhaust. The electrovalve is controlled by any suitable means such as a programmer, for example.

On the contrary, in the construction according to the invention, the pipe 15 is connected to a compressed-air reservoir 16 which is at the working pressure and has a large volume. The port 12 is supplied with oil from a power-driven pump set (not shown) through an electrovalve 17 which is provided in known manner with an exhaust port 18 for delivery to the oil reservoir of said pump set.

The operation is readily apparent. Apart from the fact that only certain stages of the cylinder 5 may be supplied in order to make it possible in accordance with conventional practice to reduce the speed of approach of the punch as this latter reaches the vicinity of the part to be formed in a press, the pneumatic pressure is very substantially constant. In actual fact, this pressure decreases very slightly during the active stroke as a result of an increase in the total volume of the chamber which encloses the compressed air. If VR is the volume of the reservoir and of the supply pipes and VC is the volume of the three stages of the cylinder 5 when the pistons 9*a*, 9*b*, 9*c* are at the end of the active stroke, the pressure P1 of the comprssed air at this moment with respect to the pressure P0 initially existing within the reservoir 16 is such that:

$$\frac{P1}{P0} = \frac{VR}{VR + VC} \text{ whence } P1 = P0 \left(1 - \frac{VC}{VR + VC}\right)$$

If the ratio $$\frac{VC}{VR + VC}$$

is small, that is to say if the volume VR of the reservoir is very large in comparison with the volume VC of the cylinder, the working pressure of the compressed air or in other words the pneumatic pressure exerted on the piston 4 of the accumulator 3 will vary to a very slight extent. This arrangement is wholly practicable since it is possible in the case of a cylinder 5 having a capacity of about 20 liters to make provision for a reservoir 16 having a capacity of 2,000 liters; a capacity of this order is mentioned by way of example since it is commonly employed although this value can in fact be considerably exceeded when so required.

In order to obtain the return stroke towards the initial position, the compressed air must be discharged in the direction of the reservoir and it is therefore necessary to apply to the piston 13 on that face which carries the rod 14 a force which is higher than that developed by the constant pressure exerted on the other face. This does not present any difficulty since the oil pressure delivered by the pump set is not limited by considerations of efficiency and leak-tightness as in the case of pneumatic pressure.

In spite of this need to develop a power which is higher than the driving power for the return stroke, the fact that the loss of the energy of expansion of the air which exists in conventional installations is suppressed accordingly makes it possible to obtain a substantial gain. This gain is further increased by the fact that the efficiency of the pump of a power-driven pump set is distinctly higher than the efficiency of a compressor. It has thus been possible in an existing installation to replace a 100 HP compressor set by a 38 HP power-driven pump set. Moreover, in the arrangement in accordance with the invention, the fact that the air is not changed overcomes the disadvantages arising from humidity and from ambient cooling.

Figure 2:
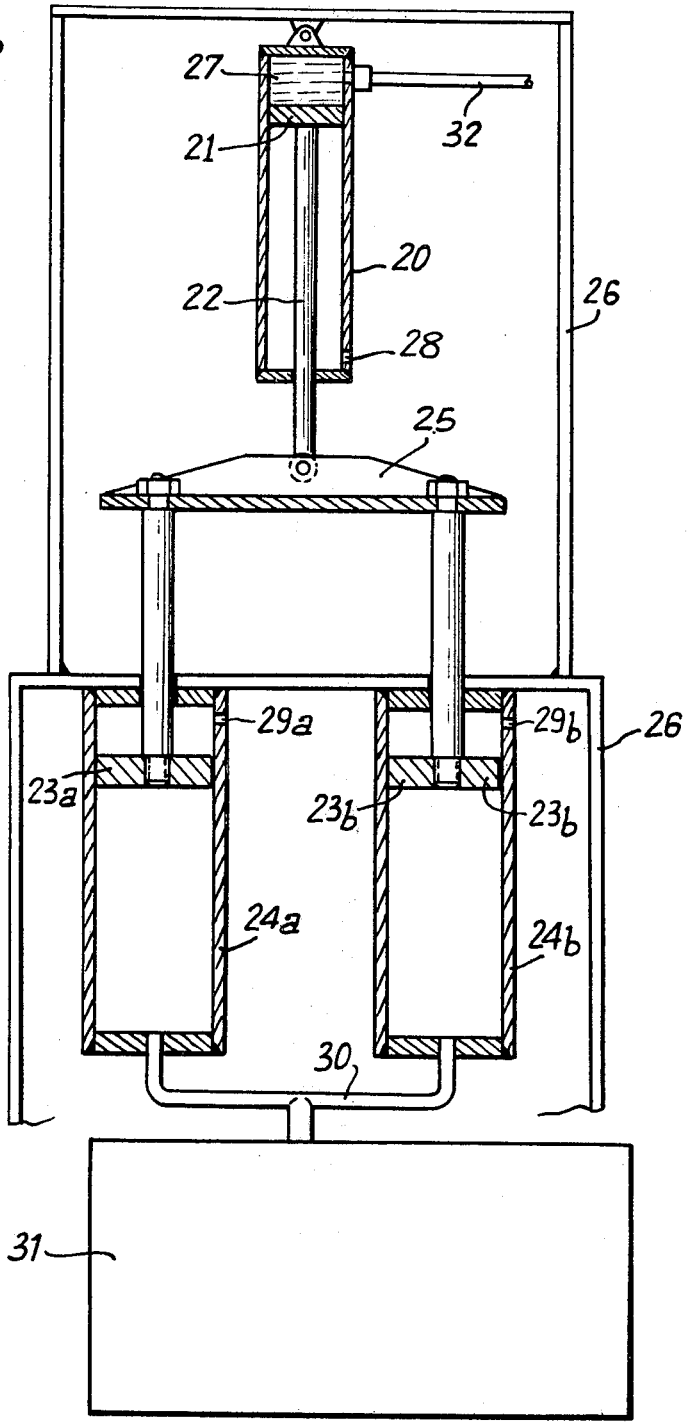
FIG. 2 shows the structure of a regulator for balancing retaining jacks.

In FIG. 2, the oleopneumatic device which is illustrated is a resistant device which performs the functions of regulator and balancing unit at the same time.

The device comprises a pressure transformer constituted by an accumulator 20, the piston 21 of which is connected by means of its rod 22 to the pistons 23*a* and 23*b* of a multiple pneumatic cylinder having two bodies 24*a* and 24*b*. This connection is established by means of a cross-member 25 which interconnects the two rods of the pistons 23*a* and 23*b*, the piston-rod 22 of the accumulator being pivotally attached to said cross-member at the midpoint of this latter. The complete assembly is mounted within a rigid frame 26 and all the cylinders are disposed vertically in the example which is illustrated, the accumulator 20 being located above the pneumatic bodies 24*a* and 24*b*. The sole object of the pneumatic cylinder structure in the form of two bodies is to obtain a large pneumatic pressure surface (the combined pistons 23*a* and 23*b*) while limiting the diameter of each cylinder, thus resulting in easier manufacture.

The lower chamber of the accumulator is provided at its base with a port 28 which opens to free air and the same applies to the upper chambers of the bodies 24*a* and 24*b* which are each provided with a port 29*a*, 29*b*. The lower chambers of the pneumatic bodies 24*a* and 24*b* are connected in parallel via a pipe 30 to a reservoir 31 containing compressed air at working pressure.

As stated earlier with reference to FIG. 1, the pneumatic pressure transmitted to the piston 21 of the accumulator is substantially constant when the volume VR of the reservoir 31 is large in comparison with the volume VC of the combined assembly of both bodies 24*a* and 24*b*, if $$\frac{VC}{VR + VC} = \frac{1}{100}$$

for example, the pressure exerted on the piston 21 decreases by 1 % when the pistons 23*a* and 23*b* move from their bottom positions to their top positions.

The upper chamber 27 of the accumulator is connected by means of a pipe 32 to a plurality of function jacks (not shown), the pressure chambers of said jacks being supplied in parallel by said pipe 32. The chambers of the jacks, the pipe 32 and the chamber 27 are filled with oil. The quantity of oil is invariable and is such that the piston 21 is located in the vicinity of its top position when the jacks are extended. If P is the practically constant pressure of the compressed air, S is the surface area of each piston 23a and 23b and s is the surface area of the piston 21, the oil transmits to each of the function jacks a practically constant pressure $H = 2\ P\ (S/s)$
and each jack develops a practically constant force which is equal to this pressure H multiplied by the surface area of the piston of the jack considered.

Each of the function jacks can be employed as a resilient means for retaining and restoring for example any mechanical component which is subjected to a variable effort. When this effort exceeds the force developed by the jack, the oil of this latter discharges into the accumulator, thus causing the pistons 23*a* and 24*a* in turn to discharge a predetermined volume of air into the reservoir. As already stated, the pressure P of the compressed air does not in that case vary to any appreciable extent, the result thereby achieved being that on the one hand the force developed by each of the other jacks undergoes practically zero variation and no overload is produced and that on the other hand, when the effort applied to the mechanical component decreases, said component is restored to its initial position without any abrupt return motion. The speed or return motion could in any case be controlled and adjusted if so required by making provision in known manner for an adjustable constriction in the oil circuit.

Figure 3:
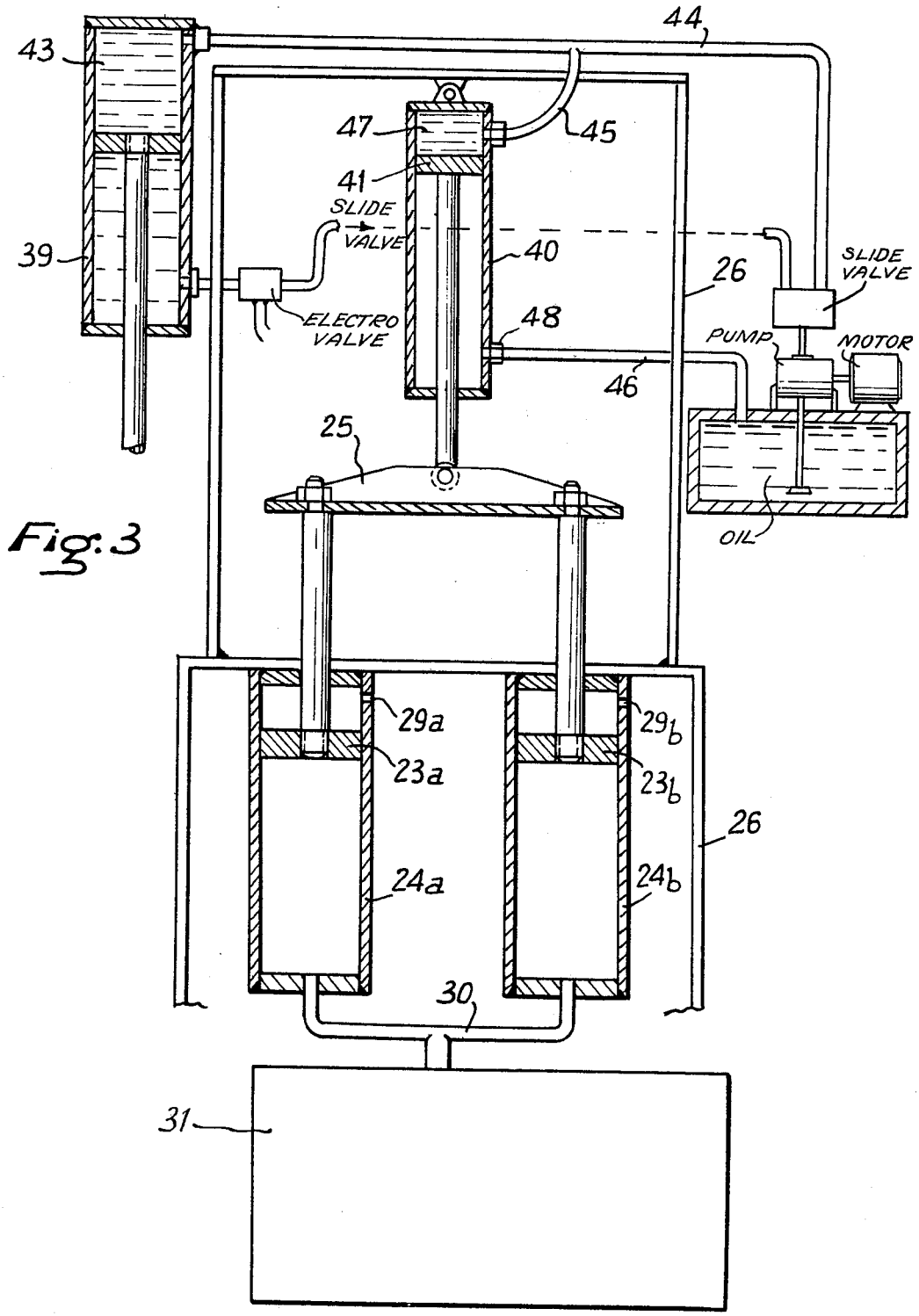
FIG. 3 illustrates the device which is employed as a pressure regulator in a circuit for the hydraulic control of a press.

In FIG. 3, the oleopneumatic device is employed as a pressure regulator in the hydraulic circuit of a function jack 39, it being assumed by way of example that said jack actuates the punch (not shown) of a press. The pneumatic portion of the pressure transformer of this device is identical with the pneumatic portion of the transformer shown in FIG. 2. Thus the same references are employed to designate the same components, namely the reservoir 31, the compressed air pipe 30, the pneumatic bodies 24*a* and 24*b* together with their pistons 23*a*, 23*b* and their upper ports 29*a*, 29*b*, the coupling cross-member 25 and the rigid frame 26. On the other hand, the accumulator 40 is slightly modified: the lower port which provides a communication with free air is replaced by a port 48 which forms the opening of a pipe 46. Said port 48 is located laterally at a point such that said pipe 46 is in communication with the upper chamber 47 of the accumulator when the piston 41 of this latter is at its bottom dead center. At the top portion of the accumulator, the chamber 47 is connected by means of a pipe 45 to the pipe 44 which serves to supply oil to the active pressure chamber 43 of the jack 39. The pipe 45 opens into the pipe 44 at a point located between the jack 39 and the electrovalve or the slide-valve (not shown) which ensures intermittent supply of the chamber 43 from a power-driven pump set (not shown). The pipe 46 is connected to the oil reservoir of said pump set.

As stated earlier in connection with the preceding examples, the pressure of the oil within the chamber 47 is practically constant. The choice of diameters of the pistons 41, 23*a* and 23*b* and of the pressure of compressed air within the reservoir 31 is such that the oil pressure aforesaid is equal to the theoretical working pressure of the oil within the hydraulic circuit 44–43 when the piston 41 is located at a short distance from the top end of the accumulator 40. The device remains static as long as said working pressure does not vary. If the jack 39 encounters a hard point which slows-down its downward motion, the accumulator absorbs the production of the pump by discharging the air to the reservoir while maintaining a very substantial constant force on the piston of the jack 39, thus enabling said jack to pass the obstacle without any jerks. As soon as the force utilized by the jack reverts to its normal value, the complete assembly is slowly restored to its initial position and the accumulator returns the quantity of oil which it has absorbed. If the piston of the jack 39 were completely jammed during its travel, the accumulator would absorb the production of the pump until the piston 41 reaches its bottom dead center, thus putting the chamber 47 into communication with the oil reservoir of the pump via the port 48 and the pipe 46, thereby establishing a circulation of oil in a closed circuit. This arrangement makes it possible to obviate faulty operation of the safety valve which is usually fitted in any hydraulic pump, said valve being now considered as only a complementary safety device.

The device in accordance with the invention can be either oleopneumatic or hydropneumatic; the pneumatic portion can comprise either a single cylinder or a cylinder having a number of parallel bodies (as shown in FIGS. 2 and 3) whilst said cylinder or each body can have a number of identical stages (as shown in FIG. 1) or stages having decreasing diameters. This device has many other potential applications which call only for detail modifications.

I claim:

1. An oleopneumatic pressure transformer including at least one first cylinder means having a high pressure side and a low pressure side open to atmosphere with first piston means reciprocal therein in response to pneumatic pressure being introduced into said cylinder on the high pressure side, an accumulator having a second cylinder with a second piston reciprocal therein which is rigidly coupled to said first piston means and actuatable by said first piston means and containing liquid responsive to actuation of said second piston, hydraulic utilization means coupled to said second cylinder of said accumulator to utilize the energy produced by the pneumatic pressure, and a pneumatic reservoir at working pressure coupled to said first cylinder means in closed circuit relationship completely isolated from said liquid and means for introducing said pneumatic pressure into said first cylinder means so that the piston therein acts as a motor element, the volume VR of said reservoir being substantial in comparison to the volume VC of said first cylinder means, so that the pneumatic working pressure is substantially constant, the ratio VC/(VR + VC) being equal to the permissible variation in the pneumatic pressure according to the energy use of said hydraulic utilization means.

2. The oleopneumatic pressure transformer as claimed in claim 1 further including pump means acting through said accumulator for discharging pneumatic pressure from said first cylinder means back into said reservoir upon the total utilization of the energy by said hydraulic utilization means.

3. The oleopneumatic pressure transformer as claimed in claim 1 wherein said first cylinder means comprises a plurality of stages connected to said reservoir in parallel.

4. The oleopneumatic device as claimed in claim 2 wherein said pump means is connected to said hydraulic utilization device.

5. The oleopneumatic device as claimed in claim 1 wherein said hydraulic utilization means comprises a plurality of hydraulic jacks connected in parallel and wherein the liquid under pressure in said accumulator is held substantially constant.

6. The oleopneumatic device as claimed in claim 2 wherein said pump means is also directly connected to said accumulator so that said pneumatic pressure acts against both said pump means and said hydraulic utilization device and so that a surge in liquid pressure will be absorbed by pneumatic pressure in said first cylinder means.

* * * * *